US010511119B2

(12) United States Patent
Makino

(10) Patent No.: US 10,511,119 B2
(45) Date of Patent: Dec. 17, 2019

(54) WATERPROOF CONNECTOR

(71) Applicant: Sumitomo Wiring Systems, Ltd., Yokkaichi, Mie (JP)

(72) Inventor: Kenji Makino, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/261,766

(22) Filed: Jan. 30, 2019

(65) Prior Publication Data

US 2019/0237899 A1 Aug. 1, 2019

(30) Foreign Application Priority Data

Feb. 1, 2018 (JP) ..... 2018-016316

(51) Int. Cl.
*H01R 13/502* (2006.01)
*H01R 13/52* (2006.01)
*H01R 13/74* (2006.01)

(52) U.S. Cl.
CPC ..... *H01R 13/5202* (2013.01); *H01R 13/502* (2013.01); *H01R 13/74* (2013.01)

(58) Field of Classification Search
CPC .. H01R 13/5202; H01R 13/502; H01R 13/74; H01R 13/5219
See application file for complete search history.

(56) References Cited

U.S. PATENT DOCUMENTS 6,953,357 B2 * 10/2005 Fukushima ..... H01R 13/5219 439/271
2012/0077377 A1 * 3/2012 Han ..... B29C 45/2628 439/587
2014/0030921 A1 * 1/2014 Kobayashi ..... H01R 13/6591 439/607.01
2014/0287631 A1 * 9/2014 Tashiro ..... H01R 13/521 439/733.1
2018/0062303 A1 * 3/2018 Kono ..... H01R 13/5202
2018/0109028 A1 4/2018 Rui
2018/0287293 A1 * 10/2018 Furuya ..... H01R 13/5202

FOREIGN PATENT DOCUMENTS

JP 2016-219381 12/2016

* cited by examiner

*Primary Examiner* — Xuong M Chung Trans
(74) *Attorney, Agent, or Firm* — Gerald E. Hespos; Michael J. Porco; Matthew T. Hespos

(57) ABSTRACT

A waterproof connector (A) includes a housing (10), a sealing member (30) including a ring-shaped seal functioning portion (31) to be fit externally on the housing (10) and sandwiched portions (36L, 36S) projecting along an outer peripheral surface of the housing (10) from the seal functioning portion (31), and a holding member 40 for resiliently sandwiching the sandwiched portions (36L, 36S) between the outer peripheral surface of the housing (10) and the holding member (40) by being mounted on the housing (10). Since the sandwiched portions (36L, 36S) of the sealing member (30) are resiliently squeezed and sandwiched between the outer periphery of the housing (10) and the holding member (40), there is no possibility that the sealing member (30) is positionally deviated from the housing (10) in a circumferential direction.

8 Claims, 14 Drawing Sheets

WATERPROOF CONNECTOR

BACKGROUND

Field of the Invention

The invention relates to a waterproof connector.

Related Art

Japanese Unexamined Patent Publication No. 2016-219381 discloses a waterproof connector with a housing having a substantially rectangular (noncircular) cross-sectional shape. A sealing member in the form of a substantially rectangular (noncircular) frame and is mounted on the outer periphery of the housing from the front. A retainer is brought into contact with the front end of the sealing member to retain the sealing member on the housing. The housing is fit into a connection space of a mating connector and a clearance between the outer periphery of the housing and the inner periphery of the mating connector is sealed in a liquid-tight manner by the sealing member.

The sealing member of the above waterproof connector is exposed on the outer periphery of the housing when the housing is separated from the mating connector. Thus, an external matter can interfere with the sealing member and may positionally deviate the sealing member in a circumferential direction. Since the sealing member is a substantially rectangular frame, if the sealing member is deviated positionally in the circumferential direction, the sealing member may not resiliently deform properly and sealing performance may be reduced when the waterproof connector is connected to the mating connector.

The invention was completed on the basis of the above situation and aims to prevent a reduction in sealing function.

SUMMARY

The invention is directed to a waterproof connector with a housing, a sealing member including a ring-shaped seal to be fit externally on the housing and a sandwiched portion projecting along an outer peripheral surface of the housing from the seal, and a holding member mounted on the housing for resiliently sandwiching the sandwiched portion between the outer peripheral surface of the housing and the holding member.

Since the sandwiched portion of the sealing member is sandwiched resiliently between the outer peripheral surface of the housing and the holding member, there is no possibility that the sealing member is deviated positionally from the housing in a circumferential direction. Thus, there is no possibility that sealing performance is reduced due to a positional deviation of the sealing member in the circumferential direction.

The seal of one embodiment has an annular shape by connecting end parts of two pairs of straight portions, and the sandwiched portion projects from an area at least including the straight portion. The straight portions of the seal easily expand and contract in the circumferential direction as compared to bent portions. The sandwiched portion is formed on the straight portion. Thus, the straight portion cannot expand and contract.

The straight portions may comprise two long sides and two short sides, and the sandwiched portions may be formed at least on the long sides. The long sides can expand and contract in the circumferential direction more easily than the short sides. Since the sandwiched portions are formed on the long sides, expandable and contractible deformation of the long sides can be prevented.

The sandwiched portion of one embodiment projects rearward from the seal, and the holding member is formed with a protection for covering the sandwiched portion from behind with the sandwiched portion sandwiched. Thus, external matter cannot interfere with the sandwiched portion.

A clearance may be provided between a rear surface of the sandwiched portion and the protecting portion with the sandwiched portion sandwiched by the holding member. According to this configuration, there is no possibility that the sandwiched portion resiliently deforms improperly by being pushed by the protecting portion. Thus, the seal will not be deformed improperly due to improper resilient deformation of the sandwiched portion.

In one embodiment, the housing has a positioning portion that is contacted by the protecting portion from behind with the sandwiched portion sandwiched by the holding member. According to this configuration, the protecting portion contacts the positioning portion when the holding member sandwiches the sandwiched portion. Thus, the protecting portion cannot improperly deform the sandwiched portion.

An opening may penetrate the protecting portion in a front-rear direction at an area of the protecting portion corresponding to the sandwiched portion. Accordingly, a state where the sandwiched portion is sandwiched can be confirmed visually through the opening.

The sandwiched portion of one embodiment projects rearward from the seal functioning portion. Additionally, a rearward facing receiving surface is formed on an outer surface of the housing, and the sandwiched portion is formed with a contact surface capable of contacting the receiving surface. According to this configuration, the sealing member can be positioned with respect to the housing in the front-rear direction by bringing the contact surface of the sandwiched portion into contact with the receiving surface of the housing. Thus, the sealing member is not positioned by the seal, but by the sandwiched portion, thereby preventing improper deformation of the seal.

DETAILED DESCRIPTION

An embodiment of the invention is described with reference to FIGS. 1 to 15. Note that, in the following description, a right side in FIGS. 3 to 5 and 11 is defined as a front concerning a front-rear direction. Upper and lower sides shown in FIGS. 1 to 9 and 11 to 15 are defined as upper and lower sides concerning a vertical direction.

Figure 1:
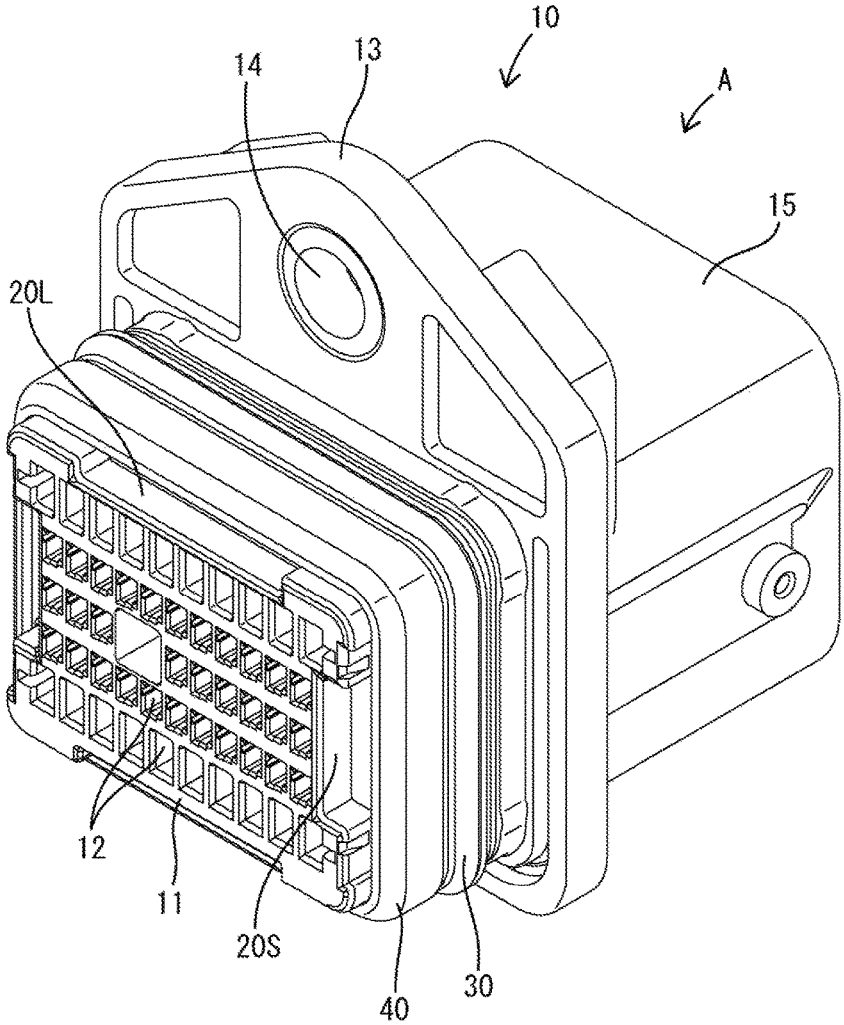
FIG. 1 is a perspective view of a waterproof connector of one embodiment.
Figure 2:
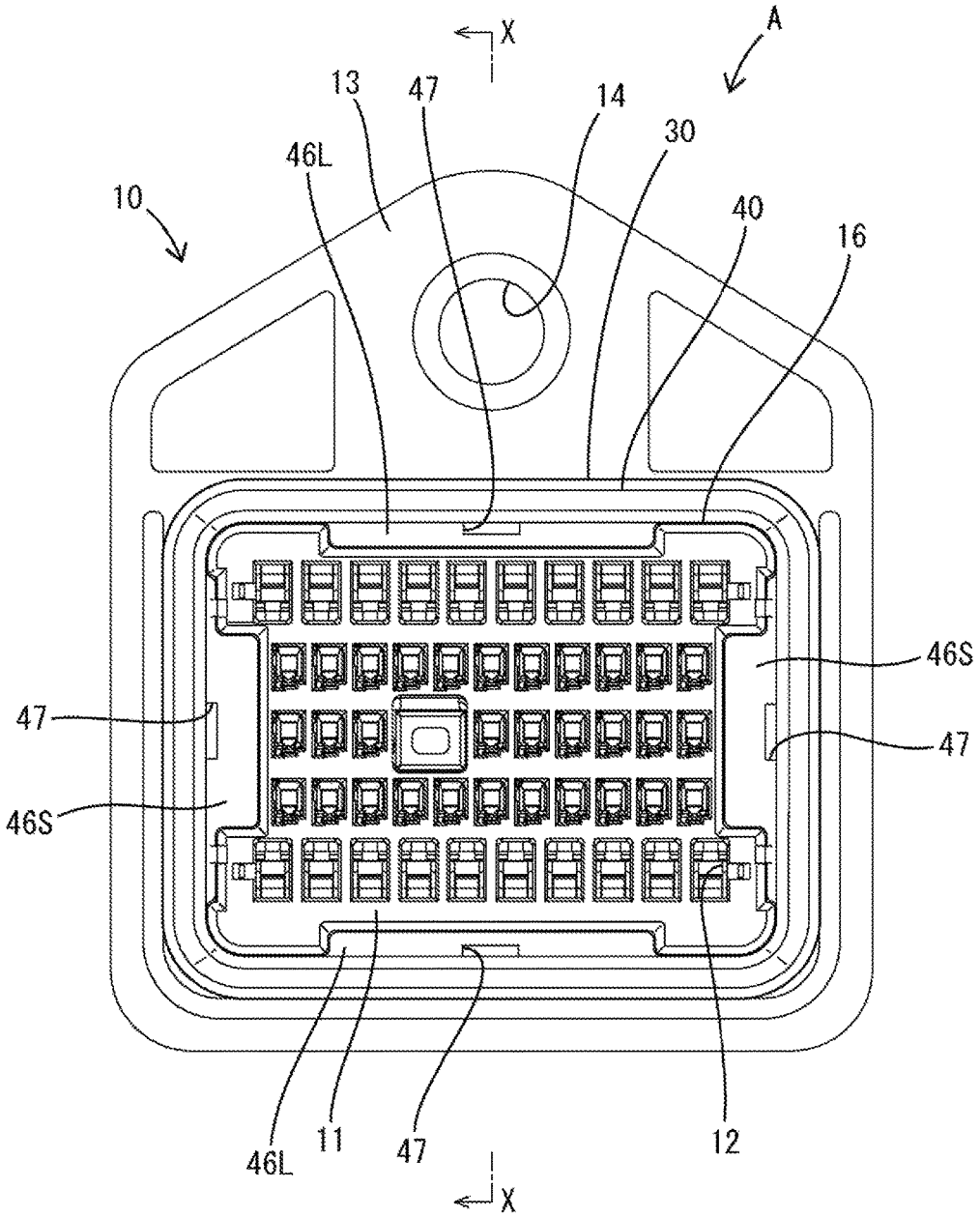
FIG. 2 is a back view of the waterproof connector.
Figure 3:
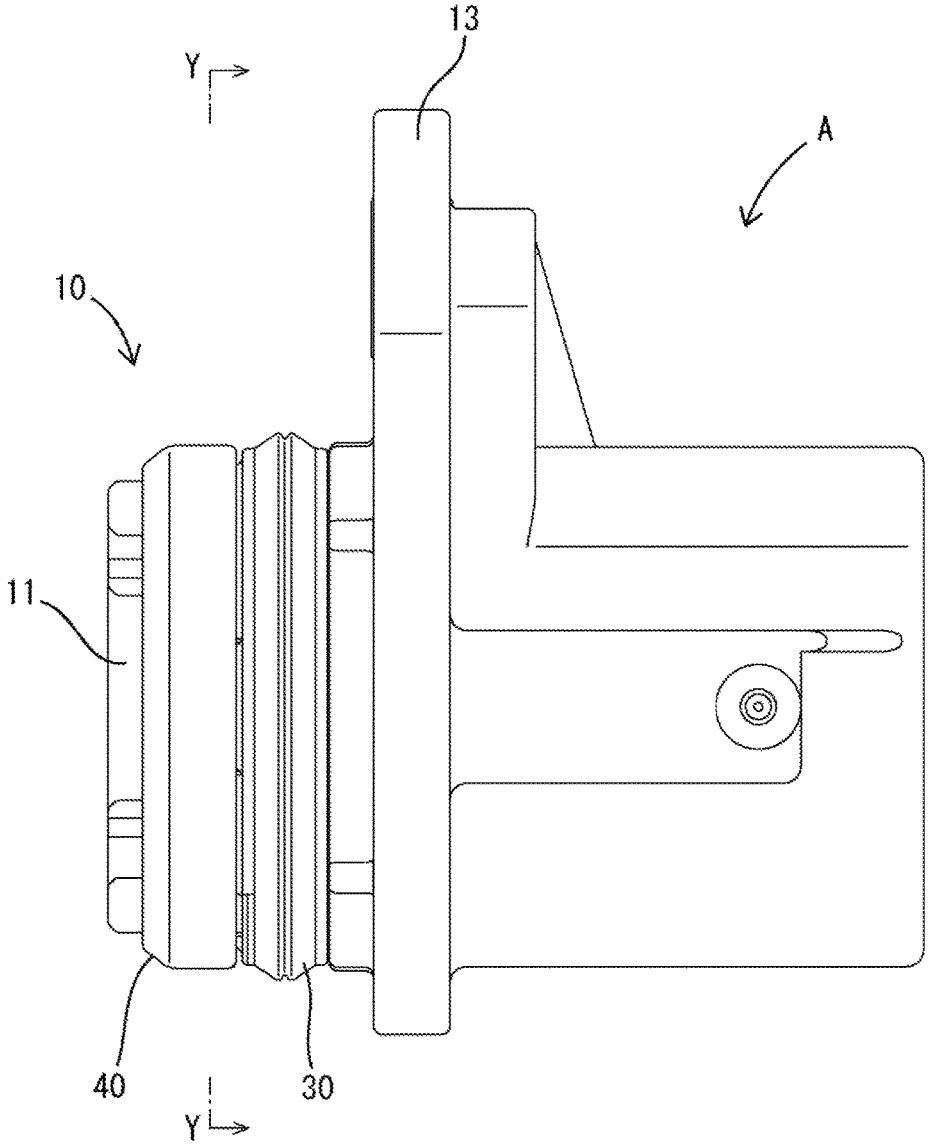
FIG. 3 is a side view of the waterproof connector.
Figure 4:
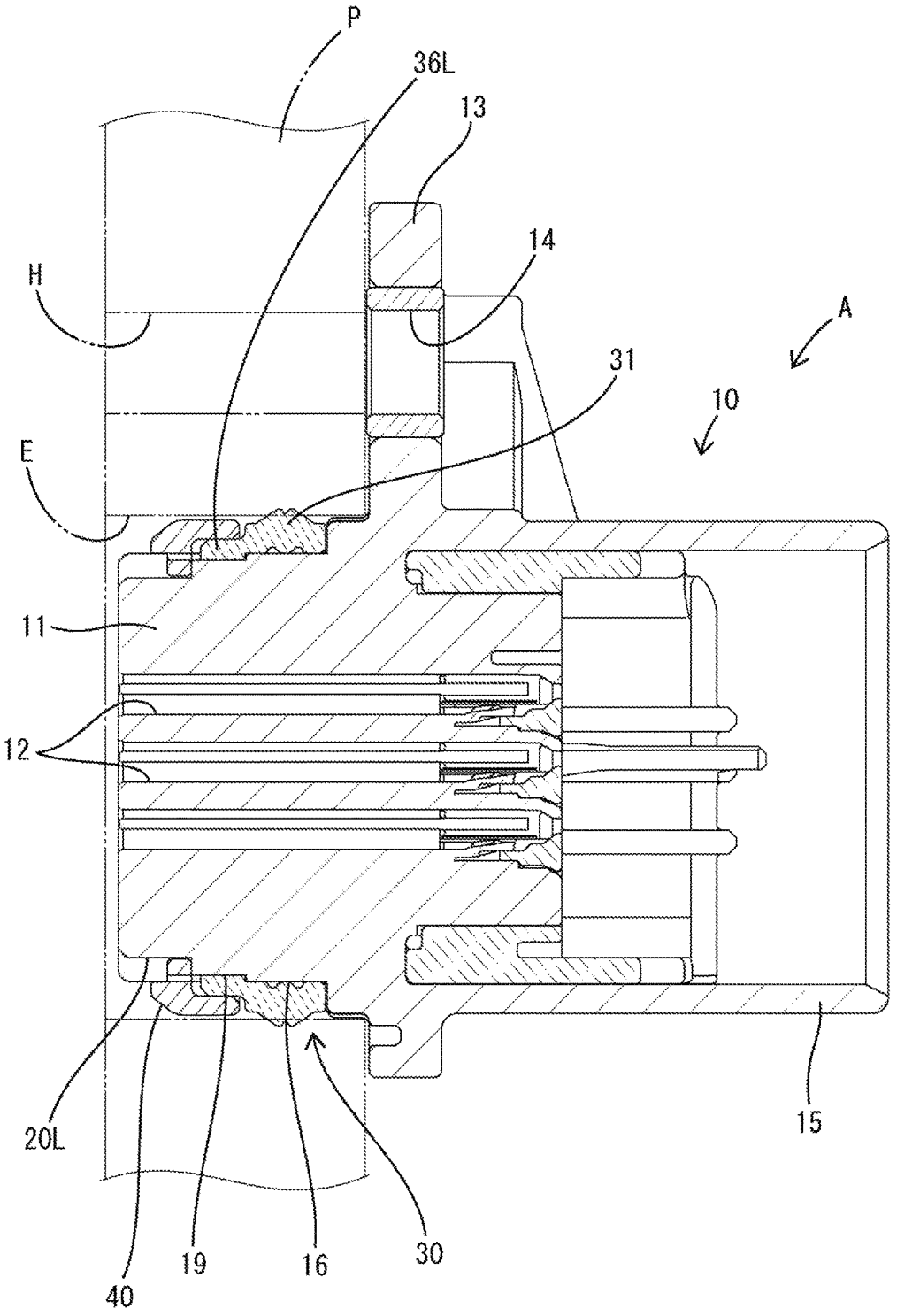
FIG. 4 is a section along X-X of FIG. 2.
Figure 7:
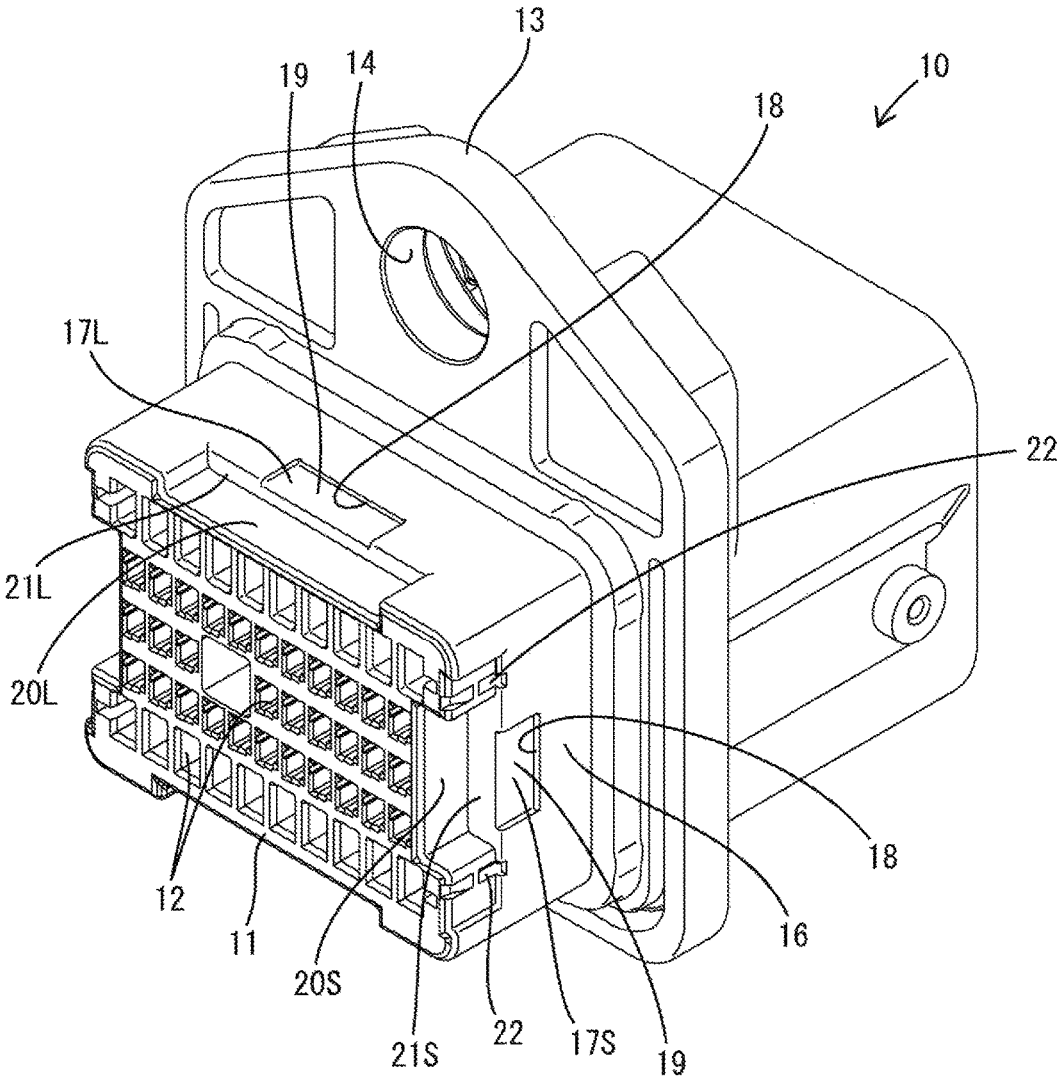
FIG. 7 is a perspective view of a housing.
Figure 8:
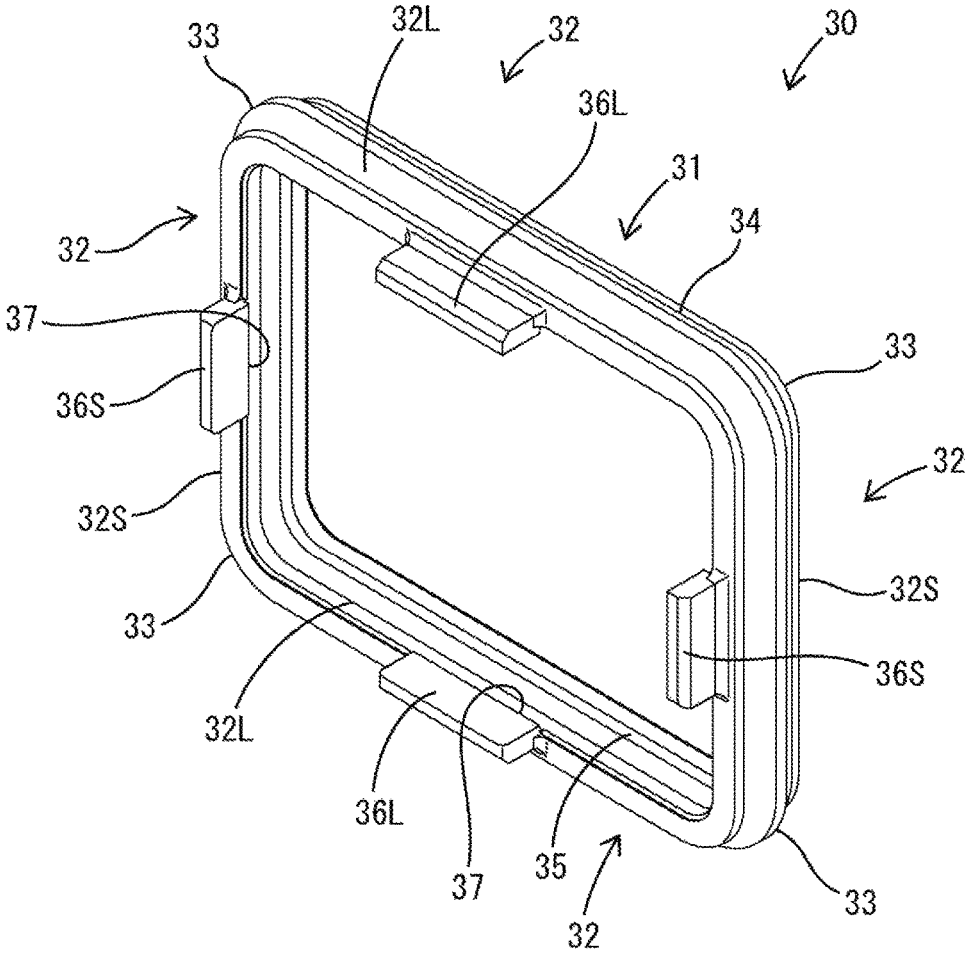
FIG. 8 is a perspective view of a sealing member.
Figure 9:
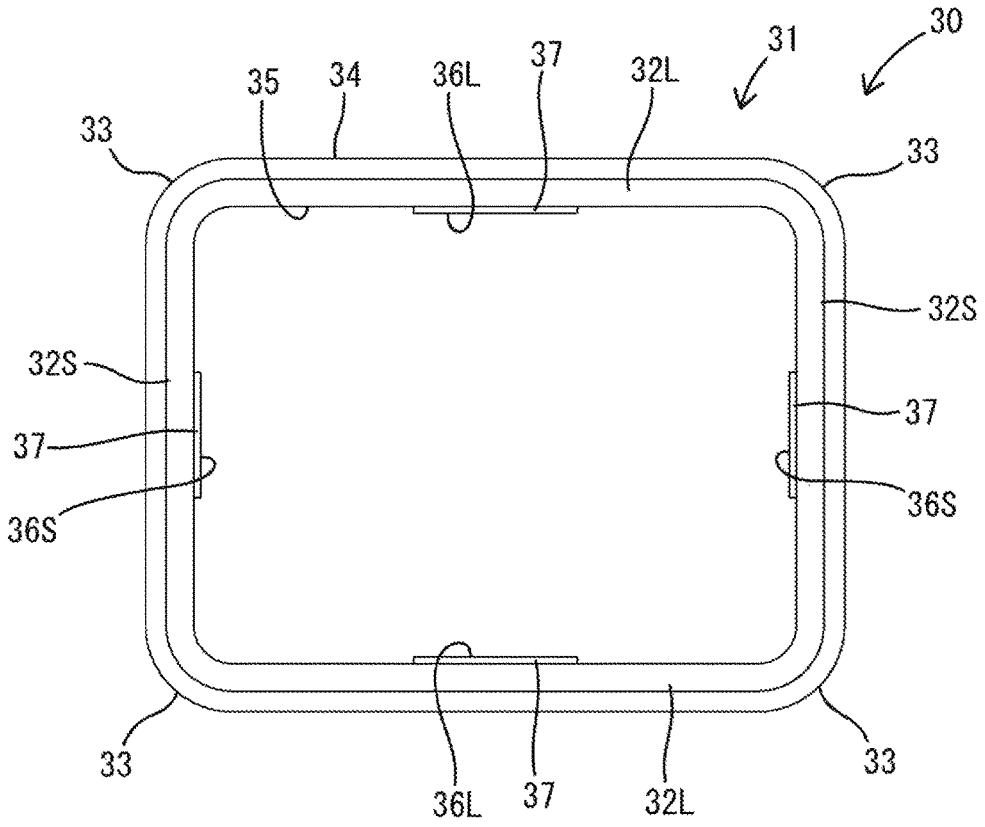
FIG. 9 is a front view of the sealing member.
Figure 10:
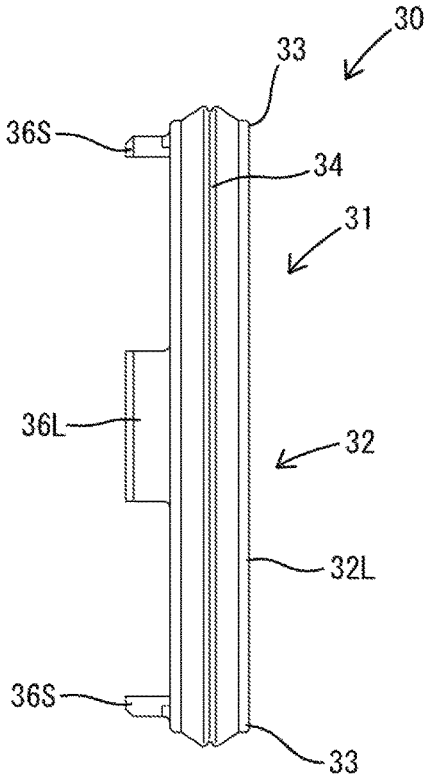
FIG. 10 is a plan view of the sealing member.
Figure 11:
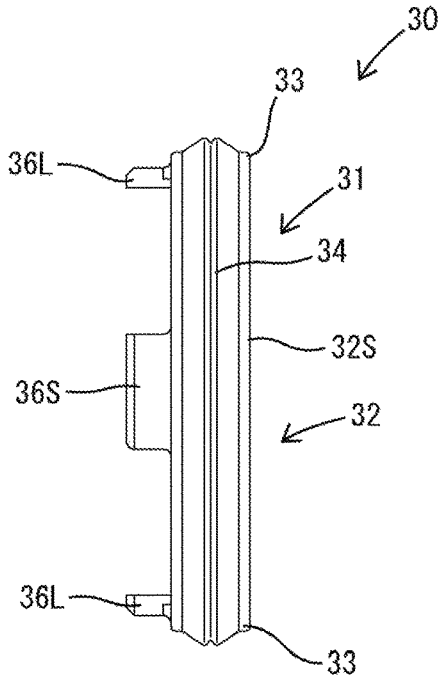
FIG. 11 is a side view of the sealing member.
Figure 12:
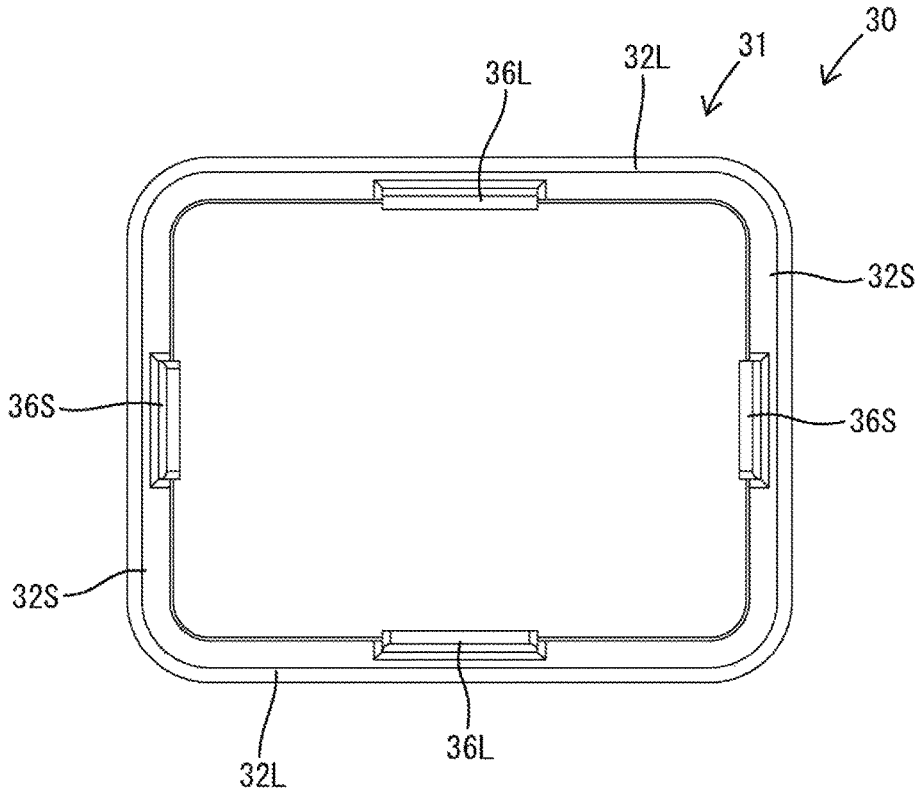
FIG. 12 is a back view of the sealing member

A waterproof connector A of this embodiment includes a housing 10 made of synthetic resin, a sealing member 30 made of an elastic material, such as rubber or elastomer, and a holding member 40 made of synthetic resin. As shown in FIGS. 4 and 7, the housing 10 includes a block-shaped terminal holding portion 11, a flange 13 vertically and laterally protruding from the outer periphery of the terminal holding portion 11, and a rectangular tubular receptacle 15 projecting forward from the outer periphery of the front surface of the terminal holding portion 11. Terminal accommodation chambers 12 are formed in the terminal holding portion 11, and a terminal fitting (not shown) is inserted into each terminal accommodation chamber 12 from behind the housing 10. A mounting hole 14 penetrates an upper wall of the flange 13 in the front-rear direction.

An area of the terminal holding portion 11 behind the flange 13 is fit into a penetrating rectangular hole E formed in a panel P of an in-vehicle device (not shown). The terminal holding portion 11 and the rectangular hole E have wide substantially rectangular shape formed by connecting two long sides extending in a lateral direction and two short sides extending in the vertical direction by four substantially quarter-circular arcs. The waterproof connector A is fixed to the panel P by fitting the terminal holding portion 11 into the rectangular hole E from the front of the panel P, bringing the flange 13 into contact with the front surface of the panel P and fastening a fastening member (not shown) inserted through the mounting hole 14 and a through hole H of the panel P.

A sealing surface 16 extends circumferentially around an area of the outer peripheral surface of the terminal holding portion 11 (housing 10) behind the flange 13. The sealing surface 16 is smooth and continuous over the entire periphery. Note that the "circumferential direction" is perpendicular to the fitting direction of the housing 10 and the rectangular hole E on the outer periphery of the terminal holding portion 11 (housing 10).

Figure 5:
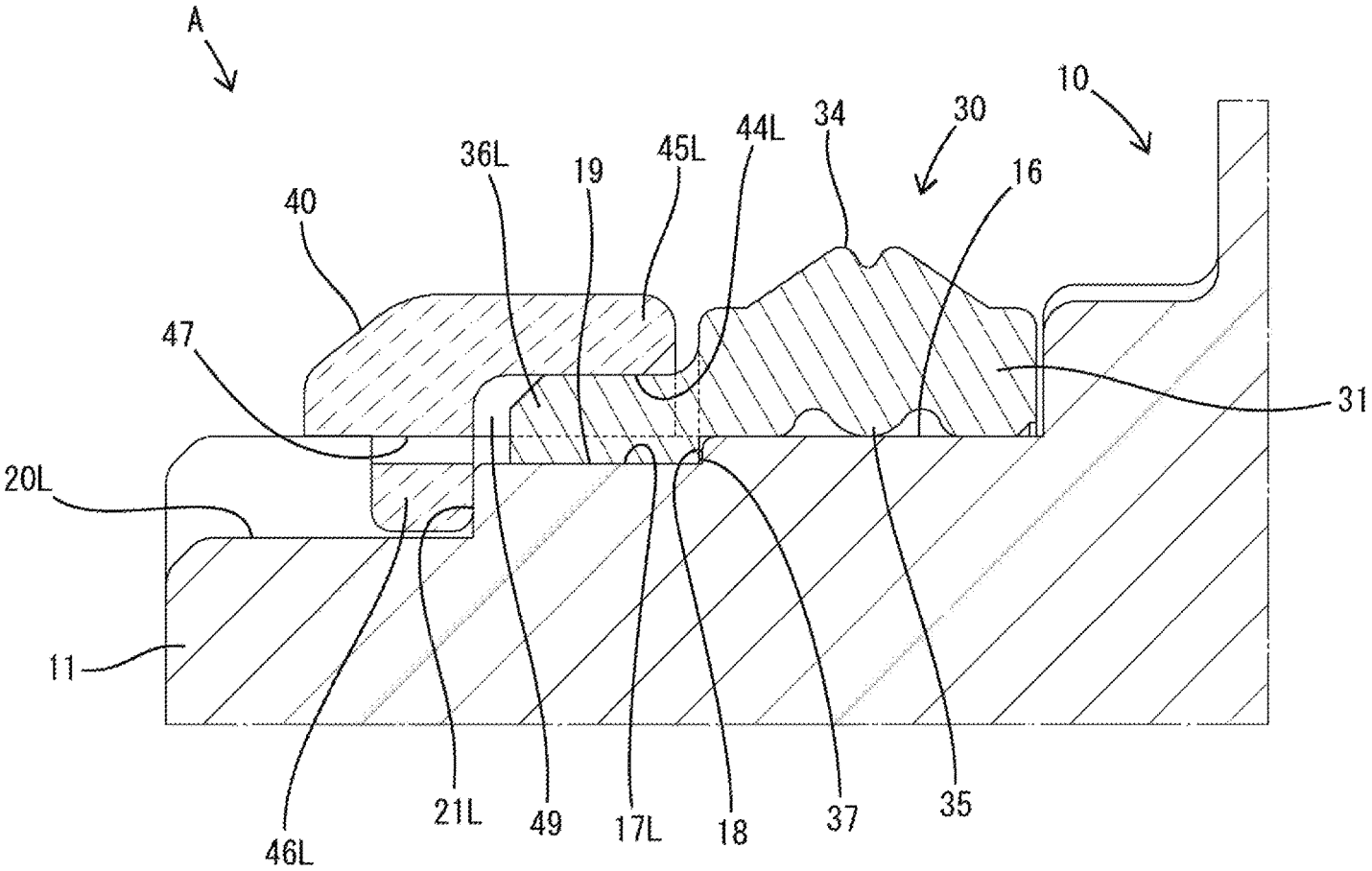
FIG. 5 is a partially enlarged view of FIG. 4.
Figure 6:
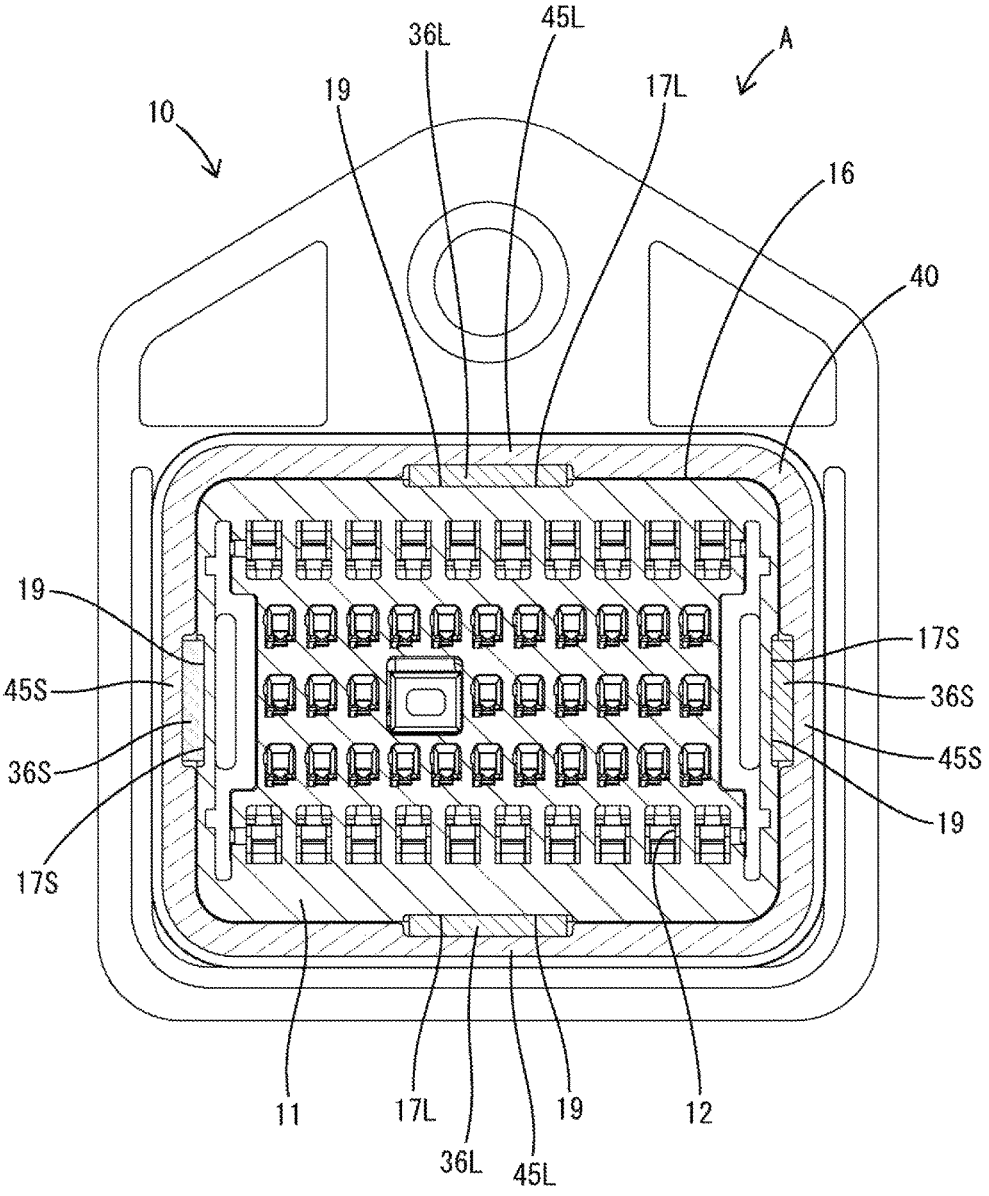
FIG. 6 is a section along Y-Y of FIG. 3.

As shown in FIGS. 5 and 7, upper and lower flat surfaces and left and right flat surfaces of the outer periphery of the terminal holding portion 11 are recessed shallowly to form two long-side positioning recesses 17L and two short-side positioning recesses 17S. The long-side positioning recesses 17L and the short-side positioning recesses 17S are open rearward of terminal holding portion 11. Each of the positioning recesses 17L and 17S has a rectangular shape with a circumferential dimension longer than a dimension in the front-rear direction.

The positioning recesses 17L and 17S are disposed behind and adjacent to the sealing surface 16 in the front-rear direction (fitting direction of the housing 10 and the rectangular hole E). The long-side positioning recesses 17L are disposed in central parts of the upper and lower flat surface parts in the lateral direction (circumferential direction), and the short-side positioning recesses 17S are disposed in central parts of the left and right flat surface parts in the vertical direction (circumferential direction).

Each of the positioning recesses 17L and 17S is recessed shallowly in a stepped manner with respect to the sealing surface 16. Rearwardly facing receiving surfaces 18 are formed on front parts of the positioning recesses 17L and 17S due to height differences between the positioning recesses 17L, 17S and the sealing surface 16. The receiving surfaces 18 are long and narrow in the circumferential direction. Further, pressure receiving surfaces 19 are defined on areas of the positioning recesses 17L and 17S behind and adjacent to the receiving surfaces 18. The pressure receiving surfaces 19 are flat surfaces constituting the outer peripheral surface of the housing 10.

As shown in FIG. 7, long-side cut portions 20L are formed in the upper and lower flat surfaces of the outer peripheral surface of the terminal holding portion 11 and are recessed deeper than the long-side positioning recesses 17L. The long-side cut portions 20L are in central parts of the upper and lower flat surfaces in the lateral direction (circumferential direction) and behind and adjacent to the long-side positioning recesses 17L. The long-side cut portion 20L in the outer peripheral surface of the terminal holding portion 11 has a rectangular shape with a longer circumferential dimension than a dimension in the front-rear direction. The circumferential dimension of the long-side cut portion 20L is larger than that of the long-side positioning recess 17L located in front of the long-side cut portion 20L. Rearwardly facing long-side positioning portions 21L are formed on front parts of the long-side cut portions 20L and are long and narrow in the circumferential direction.

Short-side cut portions 20S are formed in the left and right flat surface parts of the outer peripheral surface of the terminal holding portion 11 and are recessed deeper than the short-side positioning recesses 17S. The short-side cut portions 20S are in central parts of the left and right flat surface parts in the vertical direction (circumferential direction) and behind and adjacent to the short-side positioning recesses 17S. The short-side cut portion 20S in the outer peripheral surface of the terminal holding portion 11 has a rectangular shape with a longer circumferential dimension than a dimension in the front-rear direction. The circumferential dimension of the short-side cut portion 20S is larger than that of the short-side positioning recess 17S located in front of the short-side cut portion 20S. Rearwardly facing short-side positioning portions 21L are formed on front end parts of the short-side cut portions 20S and are long and narrow in the circumferential direction.

As shown in FIGS. 8 to 12, the sealing member 30 is composed of a seal functioning portion 31 substantially in the form of a rectangular frame, upper and lower long-side sandwiched portions 36L, and left and right short-side sandwiched portions 36S. The seal functioning portion 31 is composed of two pairs of straight portions 32 and four bent portions 33. The straight portions 32 include upper and lower straight long portions 32L extending in the lateral direction and left and right straight short portions 32S extending vertically. The four bent portions 33 are quarter-circular arcs, and smoothly connect ends of the long side straight portions 32L and ends of the short side straight portions 32S.

An outer peripheral lip 34 is formed on the outer periphery of the seal functioning portion 31 and is continuous over the entire periphery. An inner peripheral lip 35 is formed on the inner periphery of the seal functioning portion 31 and is continuous over the entire periphery. The sealing member 30 is mounted on the outer periphery of the housing 10 (terminal holding portion 11) from behind. With the sealing member 30 mounted on the housing 10, the inner peripheral lip 35 is held resiliently in close contact with the sealing surface 16. With the housing 10 fit in the rectangular hole E, the outer peripheral lip 34 is held resiliently in close contact with the inner periphery of the rectangular hole E. In this way, the sealing member 30 seals a clearance between the outer periphery of the housing 10 and the inner periphery of the rectangular hole E in a liquid-tight manner.

The four sandwiched portions 36L, 36S are ribs projecting rearward from the rear surface of the seal functioning portion 31 and are formed only on the straight portions 32. The long-side sandwiched portions 36L are disposed in central parts of the long side portions 32L in the circumferential direction (lateral direction). The long-side sandwiched portion 32L, when viewed in a direction perpendicular to the circumferential direction, is a rectangle with a larger circumferential dimension than a dimension in the front-rear direction. The shape and dimensions of the long-side sandwiched portion 36L are substantially the same as those of the long-side positioning recess 17L.

The short-side sandwiched portions 36S are in central parts of the short side portions 32S in the circumferential direction (vertical direction). The short-side sandwiched portion 32S viewed in the direction perpendicular to the circumferential direction is a rectangle having a larger circumferential dimension than a dimension in the front-rear direction. The shape and dimensions of the short-side sandwiched portion 36S are substantially the same as those of the short-side positioning recess 17S.

With the sealing member 30 mounted on the housing 10, inner peripheral parts of the long-side sandwiched portions 36L are fit in the long-side positioning recesses 17L and inner peripheral parts of the short-side sandwiched portions 36S are fit in the short-side positioning recesses 17S. In this way, the sealing member 30 (sandwiched portions 36L and 36S) is restricted from being deviated positionally in the circumferential direction with respect to the housing 10 (positioning recesses 17L and 17S).

The inner peripheral parts of the sandwiched portions 36L and 36S protrude more toward an inner peripheral side than the inner peripheral surface of the seal functioning portion 31 in a stepped manner. Forwardly facing contact surfaces 37 are formed on front parts of the sandwiched portions 36L and 36S due to a dimensional difference caused by a stepped shape. With the sealing member 30 mounted on the housing 10, four contact surfaces 37 are in surface contact with four receiving surfaces 18 of the housing 10 from behind.

The sealing member 30 is positioned with respect to the housing 10 in the front-rear direction by being held in contact with the housing 10 at four positions spaced apart in the circumferential direction. In this way, the sandwiched portions 36L and 36S have a positioning function. With the contact surfaces 37 held in contact with the receiving surfaces 18, the rear end surfaces of the sandwiched portions 36L and 36S are located respectively in front of the rear surfaces of the positioning portions 21L and 21S.

Figure 13:
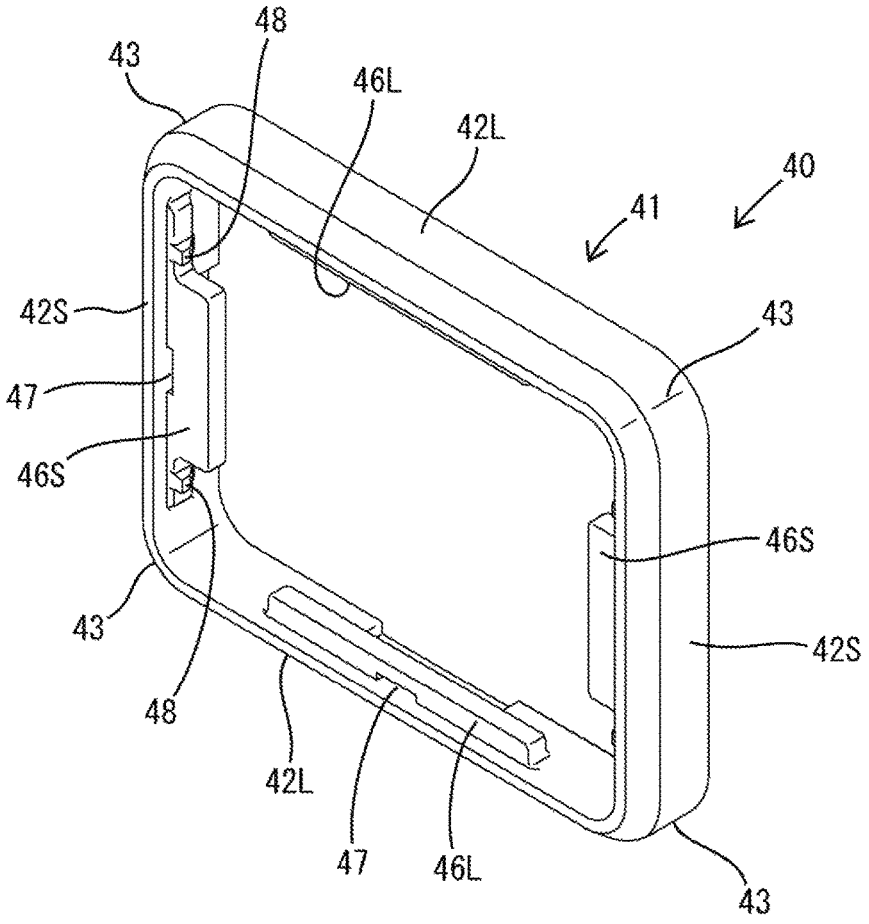
FIG. 13 is a perspective view of a holding member.
Figure 14:
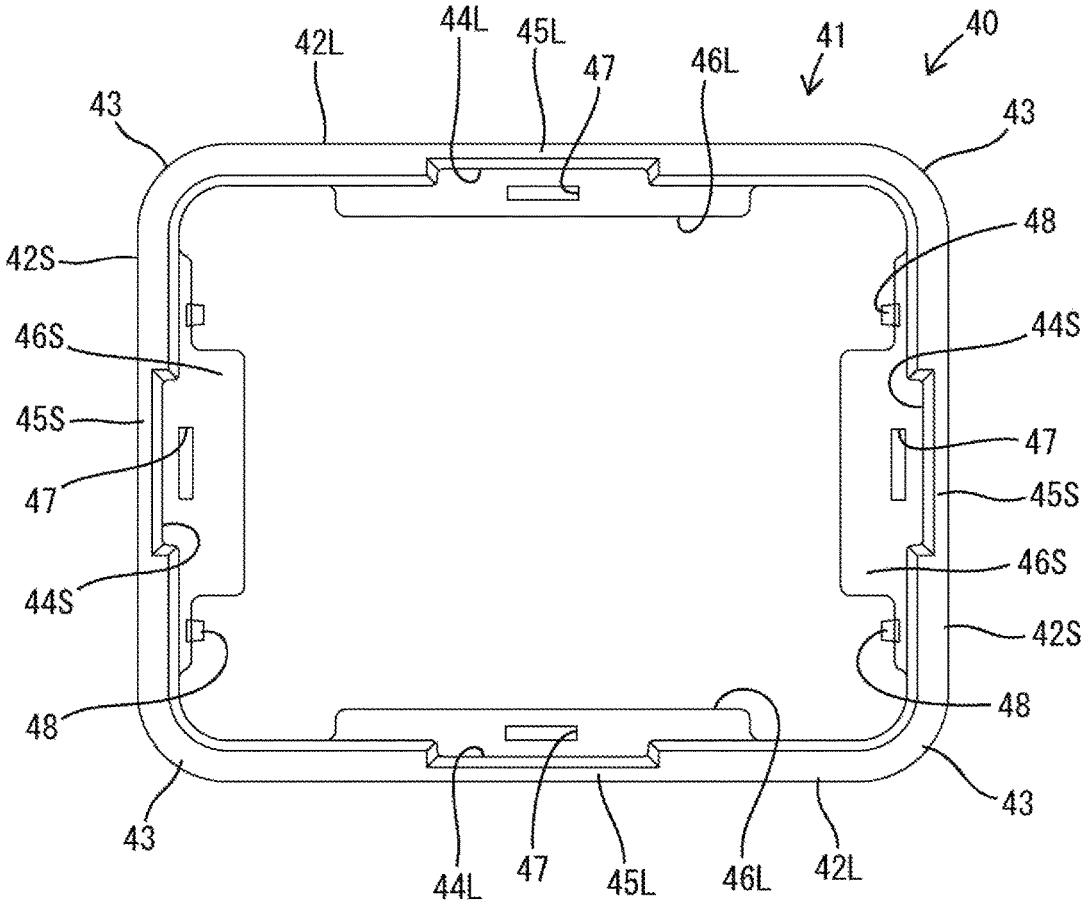
FIG. 14 is a front view of the holding member.
Figure 15:
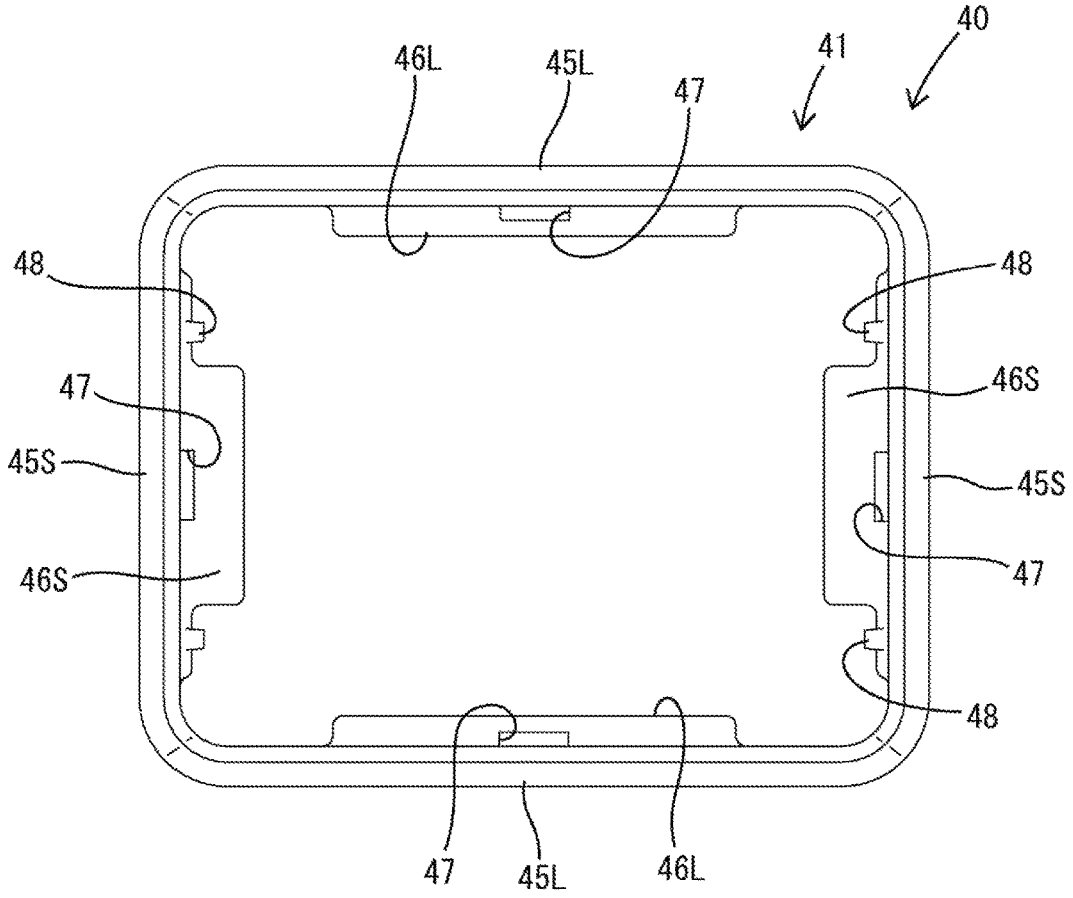
FIG. 15 is a back view of the holding member.

As shown in FIGS. 13 to 15, the holding member 40 is composed of a substantially rectangular frame-shaped body 41 with two long-side protecting portions 46L and two short-side protecting portions 46S. The frame-shaped body 41 has upper and lower long-side beams 42L extending laterally, left and right short-side beams 42S extending vertically, and four bent coupling portions 43 having a quarter-circular arc shapes. The frame-shaped body 41 has an annular shape by connecting both left and right end parts of the long-side beams 42L and both upper and lower end parts of the short-side beams 42L by the four bent coupling portions 43 into a substantially rectangular shape.

The upper and lower long-side beams 42L and the left and right short-side beams 42S on the inner periphery of the frame-shaped body 41 are formed respectively with two long-side accommodation recesses 44L and two short-side accommodation recesses 44S. The long-side accommodation recesses 44L and the short-side accommodation recesses 44S are open forward of the holding member 40. The long-side accommodation recesses 44L and the short-side accommodation recesses 44S on the inner peripheral surface of the frame-shaped body 41 have a long and narrow rectangular shape with a circumferential dimension sufficiently larger than a dimension in the front-rear direction. The long-side accommodation recesses 44L are in central parts in the lateral or circumferential direction, i.e. at positions facing the long-side positioning recesses 17L. The short-side accommodation recesses 44S are in central parts in the vertical direction, i.e. at positions facing the short-side positioning recesses 17S.

Areas of an outer periphery of the frame-shaped body 41 individually corresponding to the long-side accommodation recesses 44L in the circumferential and front-rear directions (formation areas of the long-side accommodation recesses 44L) serve as long-side pressing portions 45L. The long-side pressing portions 45L resiliently press the outer surfaces of the long-side sandwiched portions 36L toward the outer peripheral surface of the housing 10 over the entire areas of the long-side sandwiched portions 36L when the sealing member 30 and the holding member 40 are mounted on the housing 10.

Areas of the outer peripheral part of the frame-shaped body 41 corresponding to the short-side accommodation recesses 44S in the circumferential and front-rear directions (formation areas of the respective short-side accommodation recesses 44S) serve as short-side pressing portions 45S. The short-side pressing portions 45S resiliently press the outer surfaces of the short-side sandwiched portions 36S toward the outer peripheral surface of the housing 10 over the entire areas of the short-side sandwiched portions 36S when the sealing member 30 and the holding member 40 are mounted on the housing 10.

The long-side protecting portions 46L are formed on both upper and lower long-side beams 42L on the inner periphery of the frame-shaped body 41. The long-side protecting portions 46L are long and narrow laterally extending ribs projecting to an inner peripheral side from the long-side beams 42L. The long-side protecting portions 46L are disposed in central parts of the upper and lower long-side beams 42L in the lateral direction (circumferential direction), are behind and adjacent to the long-side accommodation recesses 44L and are slightly in front of the rear ends of the long-side beams 42L. A circumferential (lateral) dimension of the long-side protecting portion 46L is larger than that of the long-side accommodation recess 44L located in front of the long-side protecting portion 46L and substantially equal to a circumferential length of the long-side cut portion 20L.

The short-side protecting portions 46S are formed on both left and right short-side beams 42S on the inner periphery of the frame-shaped body 41. The short-side protecting portions 46S are long, narrow vertically extending ribs projecting to an inner peripheral side from the short-side beams 42S. The short-side protecting portions 46S are in central parts of the left and right short-side beams 42S in the vertical direction, are behind and adjacent to the short-side accommodation recesses 44S and are located slightly in front of the rear ends of the short-side beams 42S. A circumferential (vertical) dimension of the short-side protecting portion 46S is larger than that of the short-side accommodation recess 44S located in front of the short-side protecting portion 46S and substantially equal to a circumferential length of the short-side cut portion 20S.

The upper and lower long-side protecting portions 46L are formed with openings 47. Each opening 47 is arranged in a circumferential central part of the long-side beam 42L and penetrates through the long-side protecting portion 46L in the front-rear direction. Each opening 47 is a long and narrow slit in the circumferential direction and a circumferential dimension of the opening 47 is smaller than that of the long-side accommodation recess 44L in front of and adjacent to the long-side protecting portion 46L.

The left and right short-side protecting portions 46S also are formed with openings 47. Each opening 47 is in a circumferential central part of the short-side beam 42S and penetrates through the short-side protecting portion 46S in the front-rear direction. Each opening 47 is long and narrow slit in the circumferential (vertical) direction and a circumferential dimension of each opening 47 is smaller than that of the short-side accommodation recess 44S in front of and adjacent to the short-side protecting portion 46S.

With the holding member 40 mounted on the housing 10, the frame-shaped body 41 is fit on the outer periphery of the terminal holding portion 11 and is behind and adjacent to the seal functioning portion 31. When the holding member 40 is assembled properly, two pairs of left and right locking projections 48 formed on the holding member 40 are locked to two pairs of left and right locking recesses 22 (see FIG. 7) formed in the housing 10 to hold the holding member 40 on the housing 10. Note that the locking projections 48 project from positions of the inner surfaces of the short-side beams 42S near upper and lower ends of the short-side protecting portions 46S. The locking recesses 22 are formed by recessing the outer peripheral surface of the terminal holding portion 11 (or housing 10) at positions near upper and lower ends of the short-side cut portions 20S.

With the holding member 40 mounted, the long-side protecting portions 46L and the short-side protecting portions 46S are accommodated respectively in the long-side cut portions 20L and the short-side cut portions 20S. The front surfaces of the long-side protecting portions 46L contact the rear surfaces of the long-side positioning portions 21L and the front surfaces of the short-side protecting portions 46S contact the rear surfaces of the short-side positioning portions 21S to position the holding member 40 with respect to the housing 10 in the front-rear direction. In a positioned state, clearances 49 are formed between the front surfaces of the protecting portions 46L, 46S and the rear surfaces of the sandwiched portions 36L, 36S so that the sandwiched portions 36L, 36S are not squeezed in the front-rear direction by the protecting portions 46L, 46S.

With the holding member 40 mounted, the long-side accommodation recesses 44L are fit to outer peripheral parts of the long-side sandwiched portions 36L and the long-side pressing portions 45L resiliently contact outer surfaces of the long-side sandwiched portions 36L. In this way, the long-side sandwiched portions 36L are fixed by being squeezed resiliently between the long-side pressing portions 45L and the pressure receiving surfaces 19. Further, the short-side accommodation recesses 44S are fit to outer peripheral parts of the short-side sandwiched portions 36S and the short-side pressing portions 45S resiliently contact the outer surfaces of the short-side sandwiched portions 36S. In this way, the short-side sandwiched portions 36S are fixed by being squeezed resiliently between the short-side pressing portions 45S and the pressure receiving surfaces 19.

In this way, the upper and lower long-side sandwiched portions 36L are pressed between the long-side pressing portions 45L, and the pressure receiving surfaces 19 and the left and right short-side sandwiched portions 36S are pressed between the short-side pressing portions 45S and the pressure receiving surfaces 19. This pressing action holds the sealing member 30 with positional deviations in the circumferential and front-rear directions with respect to the housing 10 restricted.

The waterproof connector A of this embodiment includes the housing 10, the sealing member 30 and the holding member 40. The sealing member 31 has the ring-shaped seal functioning portion 31 to be fit externally on the housing 10 and the long-side sandwiched portions 36L and the short-side sandwiched portions 36S projecting rearward along the outer peripheral surface of the housing 10 from the seal functioning portion 31. The holding member 40 functions for resiliently squeezing and sandwiching the long-side sandwiched portions 36L and the short-side sandwiched portions 36S between the outer peripheral surface of the housing 10 and the holding member 40 by being mounted on the housing 10.

Since the long-side sandwiched portions 36L and the short-side sandwiched portions 36S of the sealing member 30 are squeezed and sandwiched resiliently between the outer peripheral surface of the housing 10 and the holding member 40, there is no possibility that the sealing member 30 positionally deviates in the circumferential direction with respect to the housing 10. Thus, there is no possibility that sealing performance is reduced due to a positional deviation of the sealing member 30 in the circumferential direction. Further, there is no possibility that the sandwiched portions 36L, 36S are turned up.

The seal functioning portion 31 has two pairs of straight portions 32 connected via the four bent portions 33 to form a substantially rectangular shape. The straight portions 32 are more likely to expand and contract in the circumferential direction than the bent portions 33. Thus, the long-side sandwiched portions 36L and the short-side sandwiched portions 36S project at least from areas including straight portions 32. The long-side sandwiched portions 36L and the short-side sandwiched portions 36S on the straight portions 32 prevent expandable and contractible deformation of the straight portions 32.

Further, the straight portions 32 include two long side portions 32L and two short side portions 32S shorter than the long side portions 32L. The long side portions 32L are easily expandably and contractibly deformed in the circumferential direction as compared to the short side portions 32S. Thus, the sandwiched portions 36L, 36S are formed on at least on the long side portions 32L (in this embodiment, on both the long side portions 32L and the short side portions 32S). The long-side sandwiched portions 32L prevent expandable and contractible deformation of the long side portions 32L.

The long-side sandwiched portions 36L and short-side sandwiched portions 36S project rearward from the seal functioning portion 31, and there is a concern that external matter approaching from behind the housing 10 may damage the sandwiched portions 36L, 36S. Accordingly, the holding member 30 is formed with the long-side protecting portions 46L for covering the long-side sandwiched portions 36L from behind with the long-side sandwiched portions 36L sandwiched and the short-side protecting portions 46S for covering the short-side sandwiched portions 36S from behind with the short-side sandwiched portions 36S sandwiched. Thus, external matter cannot interfere with the long-side sandwiched portions 36L and the short-side sandwiched portions 36S.

The long-side sandwiched portions 36L and the short-side sandwiched portions 36S are sandwiched by the holding member 40. However, clearances 49 are secured between the rear surfaces of the long-side sandwiched portions 36L and the long-side protecting portions 46L and between the rear surfaces of the short-side sandwiched portions 36S and the short-side protecting portions 46S. According to this configuration, the long-side protecting portions 46L cannot press the long-side sandwiched portions 36L from behind to cause and improper resilient deformation. Similarly, the short-side protecting portions 46S cannot press the short-side sandwiched portions 36S from behind to cause an improper resilient deformation. Thus, the seal functioning portion 31 cannot be resiliently deformed improperly due to improper resilient deformation of the long-side sandwiched portions 36L and the short-side sandwiched portions 36S.

The long-side protecting portions 46L contact the long-side positioning portions 21L of the housing 10 from behind. The long-side sandwiched portions 36L are sandwiched by the holding member 40. Additionally, the short-side protecting portions 46S contact the short-side positioning portions 21S from behind and the short-side sandwiched portions 36S sandwiched by the holding member 40. According to this configuration, when the holding member 40 sandwiches the long-side sandwiched portions 36L and the short-side sandwiched portions 36S, the long-side protecting portions 46L and the short-side protecting portions 46S contact the long-side positioning portions 21L and the short-side positioning portions 21S. Thus, the long-side protecting portions 46L cannot improperly resiliently deform the long-side sandwiched portions 36 and the short-side protecting portions 46S cannot improperly resiliently deform the short-side sandwiched portions 36S.

The openings 47 penetrate through the long-side protecting portions 46L in the front-rear direction and are formed in the areas of the long-side protecting portions 46L corresponding to the long-side sandwiched portions 36L. The openings 47 also penetrate through the short-side protecting portions 46S in the front-rear direction and are formed in the areas of the short-side protecting portions 46S corresponding to the short-side sandwiched portions 36S. According to this configuration, a state where the long-side sandwiched portions 36L and the short-side sandwiched portions 36S are sandwiched can be confirmed visually through the openings 47 from behind the housing 10 (holding member 40).

If it is attempted to position the sealing member 30 in the front-rear direction by bringing the front surface of the seal functioning portion 31 into contact with the housing 10 when the sealing member 30 is mounted on the housing 10, the seal functioning portion 31 may be deformed improperly to reduce sealing performance. Accordingly, the long-side sandwiched portions 36L and the short-side sandwiched portions 36S project rearward from the seal functioning portion 31 and the contact surfaces 37 are formed on the front parts of the long-side sandwiched portions 36L and the short-side sandwiched portions 36S.

On the other hand, the receiving surfaces 18 face rearward on the housing 10, and the contact surfaces 37 contact the receiving surfaces 18 from behind with the sealing member 30 properly assembled. According to this configuration, the sealing member 30 can be positioned with respect to the housing 10 in the front-rear direction by bringing the contact surfaces 37 of the long-side sandwiched portions 36L and the short-side sandwiched portions 36S into contact with the receiving surfaces 18 of the housing 10 so that there is no possibility that the seal functioning portion 31 is improperly deformed.

The invention is not limited to the above described and embodiment. For example, the following embodiments also are included in the scope of the invention.

Although the sandwiched portions are formed only on the straight portions (long side portions and short side portions) in the above embodiment, the sandwiched portions may be formed on the straight portions and the bent portions or only on the bent portions.

The sandwiched portions are formed on both long side portions and both short side portions in the above embodiment. However, the sandwiched portions may be formed only on the long side portions, only on the short side portions, only on the long side portions and one short side portion or only on one long side portion and the pair of short side portions.

The sandwiched portions have the positioning function and the sealing member is positioned in the front-rear direction by bringing the sandwiched portions into contact with the housing in the above embodiment. However, the sealing member may be positioned in the front-rear direction by bringing the seal functioning portion into contact with the housing.

In the above embodiment, the clearances are secured between the rear surfaces of the sandwiched portions and the protecting portions when the holding member sandwiches the sandwiched portions. However, the protecting portions may contact with the rear surfaces of the sandwiched portions when the holding member sandwiches the protecting portions.

Clearances are secured between the protecting portions and the rear surfaces of the sandwiched portions by the contact of the protecting portions with the positioning portions of the housing in the above embodiment. However, the clearances may be secured between the protecting portions and the rear surfaces of the sandwiched portions by the contact of the front surface of the holding member with the rear surface of the seal functioning portion.

Although the protecting portions are formed with the openings in the above embodiment, the protecting portions may include no opening.

Although as many protecting portions as the sandwiched portions are arranged to correspond to the sandwiched portions in the above embodiment, a protecting portion may be formed continuously over the entire periphery.

The holding member may include no protecting portion.

LIST OF REFERENCE SIGNS

A . . . waterproof connector
10 . . . housing
18 . . . receiving surface
21L . . . long-side positioning portion (positioning portion)
21S . . . short-side positioning portion (positioning portion)
30 . . . sealing member
31 . . . seal functioning portion
32 . . . straight portion
32L . . . long side portion
32S . . . short side portion
33 . . . bent portion
36L . . . long-side sandwiched portion (sandwiched portion)
36S . . . short-side sandwiched portion (sandwiched portion)
37 . . . contact surface
40 . . . holding member
46L . . . long-side protecting portion (protecting portion)
46S . . . short-side protecting portion (protecting portion)
47 . . . opening
49 . . . clearance

What is claimed is:

1. A waterproof connector, comprising:

a housing;

a sealing member including a ring-shaped seal functioning portion fit externally on the housing and a sandwiched portion projecting along an outer peripheral surface of the housing from the seal functioning portion; and a holding member for resiliently sandwiching the sandwiched portion between the outer peripheral surface of the housing and the holding member by being mounted on the housing.

2. The waterproof connector of claim 1, wherein:

the seal functioning portion has an annular shape by connecting end parts of two pairs of straight portions; and the sandwiched portion projects from an area at least including the straight portion.

3. The waterproof connector of claim 2, wherein:

the two pairs of straight portions are composed of two long side portions and two short side portions shorter than the pair of long side portions; and the sandwiched portions are formed at least on the long side portions.

4. The waterproof connector of claim 1, wherein:

the sandwiched portions project rearward from the seal functioning portion; and the holding member is formed with a protecting portion for covering the sandwiched portion from behind with the sandwiched portion sandwiched.

5. The waterproof connector of claim 4, wherein a clearance is secured between a rear surface of the sandwiched portion and the protecting portion with the sandwiched portion sandwiched by the holding member.

6. The waterproof connector of claim 4, wherein the housing is formed with a positioning portion with which the protecting portion is brought into contact from behind with the sandwiched portion sandwiched by the holding member.

7. The waterproof connector of claim 4, wherein an opening penetrating through the protecting portion in a front-rear direction is formed in an area of the protecting portion corresponding to the sandwiched portion.

8. The waterproof connector of claim 1, wherein:

the sandwiched portion projects rearward from the seal functioning portion;

a receiving surface facing rearward is formed on an outer surface of the housing; and the sandwiched portion is formed with a contact surface capable of contacting the receiving surface.

* * * * *